US008813820B1

(12) United States Patent
Chang et al.

(10) Patent No.: US 8,813,820 B1
(45) Date of Patent: Aug. 26, 2014

(54) GRAVITY CASTING MOLD

(71) Applicant: SEYUN SCS Corporation, Gimhae-si (KR)

(72) Inventors: Sehoon Chang, Seoul (KR); Ildo Jung, Ulsan (KR)

(73) Assignee: SEYUN SCS Corporation (KR)

( * ) Notice: Subject to any disclaimer, the term of this patent is extended or adjusted under 35 U.S.C. 154(b) by 0 days.

(21) Appl. No.: 14/150,065

(22) Filed: Jan. 8, 2014

(30) Foreign Application Priority Data

Jul. 25, 2013 (KR) ..... 10-2013-0088231

(51) Int. Cl.
*B22C 9/22* (2006.01)
*B22C 9/10* (2006.01)

(52) U.S. Cl.
CPC ..... *B22C 9/22* (2013.01)
USPC ..... 164/339; 164/369

(58) Field of Classification Search
USPC ..... 164/271, 137, 339, 340, 341, 342, 349, 164/364, 365, 369
See application file for complete search history.

(56) References Cited

U.S. PATENT DOCUMENTS 6,860,315 B2 * 3/2005 Williamson ..... 164/133
8,267,151 B2 * 9/2012 Chu et al. ..... 164/339

FOREIGN PATENT DOCUMENTS

KR 1020030091906 12/2003
KR 1020050047577 5/2005
KR 1020110063107 6/2011
KR 101180951 9/2012

* cited by examiner

*Primary Examiner* — Kevin P Kerns
(74) *Attorney, Agent, or Firm* — Cantor Colburn LLP

(57) ABSTRACT

A gravity casting mold including a first mold, a second mold and an exhaust runner mold, which are combined with each other and form a turbine housing cavity having a twin scroll part, a first riser, a sprue, a runner, a second riser, an exhaust manifold cavity, third risers and gates. A heating sleeve is provided in the first riser so as to prevent shrinkage of the molten metal in the twin scroll part. The heating sleeve is closed in an upper end, with a gas ejection hole formed through the upper end of the heating sleeve. A sprue cup is provided in the sprue so as to maintain the temperature of the molten metal in the sprue. The gravity casting mold further includes a twin scroll mold, a main gate core, an exhaust runner core, a twin scroll part core and a bypass part core, and a sub-gate core.

14 Claims, 12 Drawing Sheets
(5 of 12 Drawing Sheet(s) Filed in Color)

GRAVITY CASTING MOLD

BACKGROUND OF THE INVENTION

1. Field of the Invention

The present invention relates to a gravity casting mold, which is provided with a heating sleeve in a first riser.

2. Description of the Related Art

Generally, gravity casting is a casting technology in which a molten metal poured into a casting mold is solidified by gravity of the molten metal. Gravity casting is characterized in that the molten metal quickly cools and can form fine crystal grains.

Particularly, gravity casting is preferably used by automobile manufacturers to cast a variety of parts for automobiles, such as engines composed of cylinder heads and cylinder blocks, camshafts, crankshafts, suction and exhaust manifolds, turbine housings, etc. To produce a part of an automobile, a body of the part is formed by gravity casting and is subjected to a variety of machining processes, so a cast product can be produced.

In recent years, the shape of an exhaust system of engines has been optimally designed according to wide use of a gasoline turbocharger, and this has led to active study of a technology of integrally producing a twin scroll turbocharger and an exhaust manifold in an effort to realize an improvement in durability and air-tightness of the parts and to realize an increase in a profit. That is, it is required to integrally cast a turbine housing for a twin scroll turbocharger and an exhaust manifold composed of four exhaust runners, in which the turbine housing has a bypass section and a twin scroll section formed by first and second scroll parts that are spaces defined in the turbine housing.

An example of conventional gravity casting molds for integrally casting the exhaust manifold and the turbine housing into a single body is referred to Korean Patent No. 1180951 (registered on Sep. 3, 2012, entitled "gravity pressure casting mold and gravity pressure casting method using the mold").

The conventional gravity casting mold disclosed in Korean Patent No. 1180951 is problematic in that, although a riser for a turbine housing cavity is provided in the gravity casting mold, molten metal in the riser quickly cools, so molten metal may not be efficiently fed from the riser to the turbine housing cavity as the molten metal in the turbine housing cavity is cooling and shrinking, and this may cause shrinkage defects in a cast product that is a turbine housing.

The foregoing is intended merely to aid in the understanding of the background of the present invention, and is not intended to mean that the present invention falls within the purview of the related art that is already known to those skilled in the art.

DOCUMENTS OF RELATED ART (Patent Document) Korean Patent No. 1180951

SUMMARY OF THE INVENTION

Accordingly, the present invention has been made keeping in mind the above problems occurring in the related art, and the present invention is intended to propose a gravity casting mold which is configured such that, when molten metal in a twin scroll part of the mold cools and shrinks, hot molten metal having high temperature heat can be added to the twin scroll part and prevents the cooling and shrinking of the molten metal in the twin scroll part, so the present invention can realize a great improvement in the quality of castings.

In order to achieve the above object, according to one aspect of the present invention, there is provided a gravity casting mold including: a first mold having: a first part of a turbine housing cavity formed in a lower part of the first mold and having a twin scroll part; a first part of a first riser formed at a location above the twin scroll part; first parts of a sprue and of a runner formed in a first side of the twin scroll part so as to feed molten metal into the twin scroll part; and a first part of a second riser formed in a second side of the twin scroll part; a second mold assembled with the first mold, the second mold having: a second part of the turbine housing cavity formed in a lower part of the second mold and engaged with the first part of the turbine housing cavity of the first mold so as to form the turbine housing cavity; a first part of an exhaust manifold cavity formed in an upper part of the second mold and connected to the second part of the turbine housing cavity; and a first part of a third riser formed at a location above the first part of the exhaust manifold cavity; and an exhaust runner mold placed in an upper part between the first mold and the second mold, wherein a first surface of the exhaust runner mold has: a second part of the exhaust manifold cavity engaged with the first part of the exhaust manifold cavity of the second mold so as to form the exhaust manifold cavity; and a second part of the third riser formed at a location above the second part of the exhaust manifold cavity and engaged with the first part of the third riser so as to form the third riser, and a second surface of the exhaust runner has: a second part of the first riser engaged with the first part of the first riser of the first mold so as to form the first riser; second parts of the sprue and of the runner engaged with the first parts of the sprue and of the runner of the first mold so as to form the sprue and the runner; and a second part of the second riser engaged with the first part of the second riser of the first mold so as to form the second riser, wherein a heating sleeve is provided in the first riser so as to prevent shrinkage of the molten metal in the twin scroll part, wherein the heating sleeve is closed in an upper end, with a gas ejection hole formed through the upper end of the heating sleeve.

In the present invention, the heating sleeve may have a cylindrical shape, with a width between opposed portions of a sidewall of the heating sleeve gradually increased in a downward direction.

In the present invention, upper ends of the first part of the first riser of the first mold and of the second part of the first riser of the exhaust runner mold may be provided with gas ejection ports, the gas ejection ports communicating with the gas ejection hole of the heating sleeve and being open in upper ends so as to expel gas from the first riser.

In the present invention, the heating sleeve may be provided on an inner surface of the upper end thereof with a guide protrusion having a downward tapering shape.

In the present invention, a sprue cup may be provided in the sprue so as to maintain a temperature of the molten metal in the sprue.

In the present invention, the first riser may have a diameter larger than a diameter of a lowermost end of the sprue within a range of 1.5 to 2.5 times.

In the present invention, the first mold may be provided with a first part of a first gate, the first part of the first gate connecting the first part of the runner to the first part of the first riser, and the exhaust runner mold may be provided with a second part of the first gate, the second part of the first gate connecting the second part of the runner to the second part of the first riser and engaged with the first part of the first gate so as to form the first gate.

The gravity casting mold of the present invention may further include: twin scroll mold placed in a lower part between the first mold and the second mold and forming a lower part of the turbine housing cavity; a main gate core placed in a lower part between the first part of the runner of the first mold and the second part of the runner of the exhaust runner mold, the main gate core connecting the runner to the turbine housing cavity and forming a plurality of second gates; an exhaust runner core placed between the second mold and the exhaust runner mold at a location inside the exhaust manifold cavity and forming an exhaust runner of an exhaust manifold; a twin scroll part core and a bypass part core placed between the first mold and the second mold at locations inside the turbine housing cavity, and respectively forming a twin scroll section and a bypass section which are formed by an inner space of a turbine housing; and a sub-gate core placed in the lower part between the first mold and the second mold at a location next to the bypass part core, the sub-gate core connecting the second riser to the bypass part core and forming a plurality of third gates.

The gravity casting mold according to the present invention is advantageous as follows.

The heating sleeve having a high temperature heat generating function and an excellent insulation function is provided in the first riser, so the heating sleeve can maintain the high temperature of the molten metal in the first riser without lowering the temperature. Thus, when the molten metal in the twin scroll part is cooling and shrinking, the present invention can prevent the cooling and shrinking of the molten metal in the twin scroll part by feeding hot molten metal into the twin scroll part. Accordingly, the present invention can greatly increase the quality of cast products.

Further, the present invention is advantageous in that gas generated during the charging of the molten metal in the mold can be efficiently expelled to the outside through the gas ejection ports of the first and second risers, so it is possible to prevent mixing of gas with the molten metal in the end of the twin scroll part and to avoid shrinkage defects that may be formed on a surface of cast products.

Further, when molten metal both in the turbine housing cavity and in the exhaust manifold cavity of the gravity casting mold cools and shrinks, hot molten metal is fed from the first and second risers into the turbine housing cavity, and hot molten metal is fed from the third riser into the exhaust manifold cavity, so the short amount of molten metal caused by the cooling and shrinking of the molten metal can be replenished. Accordingly, the present invention can prevent shrinkage defects in cast products, and increases the casting quality of the cast products.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other objects, features and other advantages of the present invention will be more clearly understood from the following detailed description when taken in conjunction with the accompanying drawings, in which.

DETAILED DESCRIPTION OF THE INVENTION

Hereinbelow, the preferred embodiment of the present invention will be described in detail with reference to the accompanying drawings. The terminologies or words used in the description and the claims of the present invention should not be interpreted as being limited merely to their common and dictionary meanings. On the contrary, they should be interpreted based on the meanings and concepts of the invention in keeping with the scope of the invention based on the principle that the inventor(s) can appropriately define the terms in order to describe the invention in the best way.

Accordingly, it is to be understood that the form of the invention shown and described herein is to be taken as a preferred embodiment of the present invention, so it does not express the technical spirit and scope of this invention. Accordingly, it should be understood that various changes and modifications may be made to the invention without departing from the spirit and scope thereof.

Figure 1:
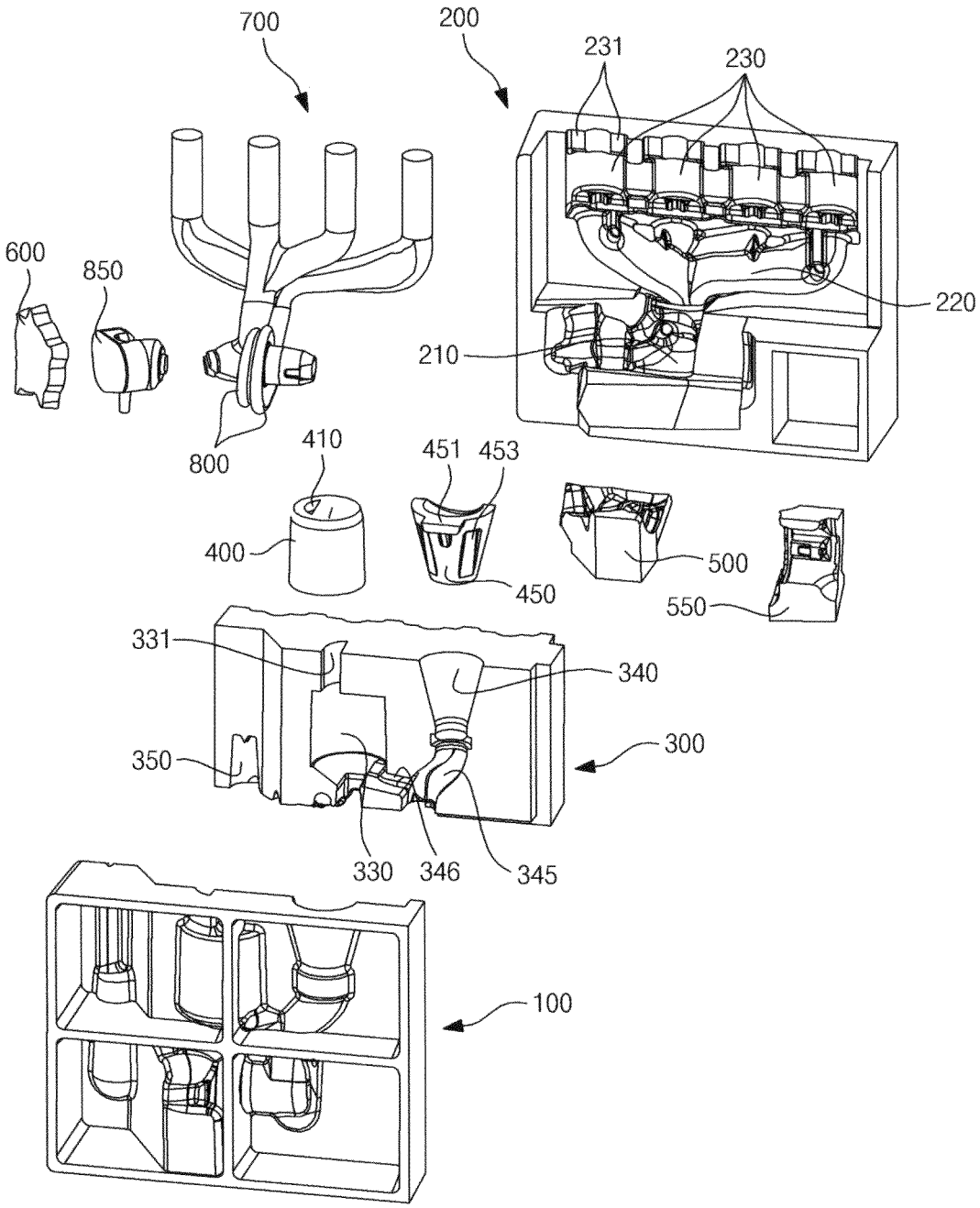
FIGS. 1 and 2 are exploded perspective views of a gravity casting mold according to a preferred embodiment of the present invention.
Figure 2:
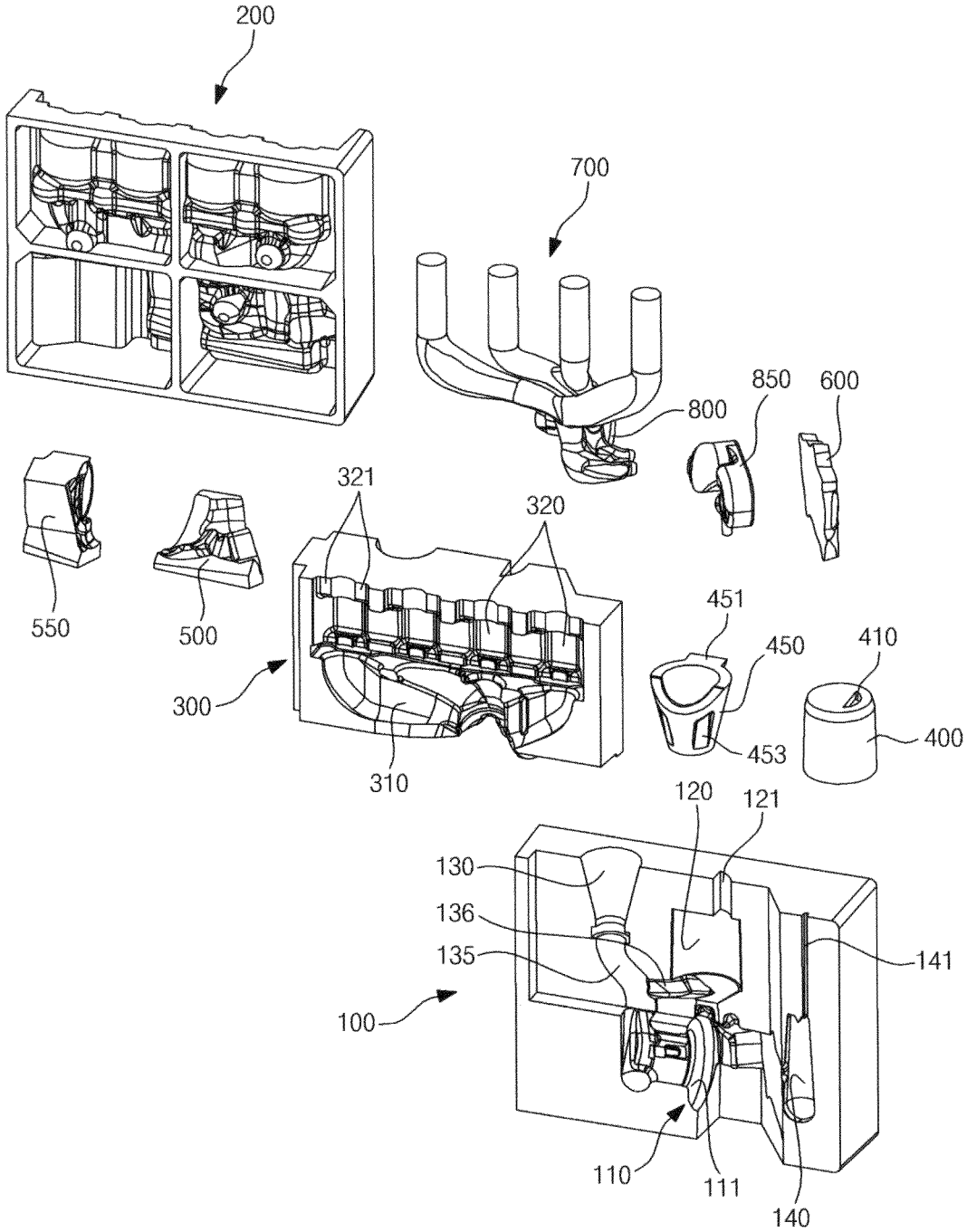

As shown in FIGS. 1 and 2, the gravity casting mold according to the preferred embodiment of the present invention includes a first mold 100, a second mold 200, an exhaust runner mold 300, a twin scroll mold 500 and a main gate core 550.

As shown in FIG. 2, a first part 110 of a turbine housing cavity, which has a twin scroll part 111, is provided in a lower part of the first mold 100.

At a position above the twin scroll part 111, a first part 120 of a first riser is formed. A gas ejection port 121 is formed at a position above the first part 120 of the first riser. The gas ejection port 121 is open in the upper end thereof and expels gas to the outside of the gravity casting mold.

At one side of the twin scroll part 111, a first part 130 of a sprue and a first part 135 of a runner, which are used to feed a molten metal into the twin scroll part 111, are formed. The first part 130 of the sprue is configured such that the upper end thereof is open, and the width between opposed portions of the sidewall thereof is gradually reduced in a downward direction.

At the other side of the twin scroll part 111, a first part 140 of a second riser is formed at a position spaced apart from the twin scroll part 111. In other words, the first part 140 of the second riser is arranged at a location near a sub-gate core 600 that will be described later herein. A gas ejection port 141 extends upward from the upper end of the first part 140 of the second riser. The upper end of the gas ejection port 141 is open so as to eject gas to the outside of the gravity casting mold.

In the above-mentioned first mold 100, a first part 136 of a first gate which connects the first part 135 of the runner to the first part 120 of the first riser is formed, so the first part 135 of the runner communicates with the first part 120 of the first riser by the first part 136 of the first gate.

The second mold 200 is assembled with the first mold 100 into a gravity casting mold assembly. As shown in FIG. 1, a second part 210 of the turbine housing cavity, which forms the turbine housing cavity in combination with the first part 110 of the turbine housing cavity of the first mold 100, is formed in a lower part of the second mold 200.

Further, a first part 220 of an exhaust manifold cavity, which is connected to the second part 210 of the turbine housing cavity, is formed in an upper part of the second mold 200. In the present embodiment, the first part 220 of the exhaust manifold cavity includes four exhaust runner cavities.

First parts 230 of third risers are formed in the respective upper ends the four exhaust runner cavities of the first part 220 of the exhaust manifold cavity. A gas ejection port 231 extends upward from the upper end of each of the first parts 230 of the third risers. The gas ejection port 231 is open in the upper end thereof and ejects gas to the outside of the gravity casting mold. In the present embodiment, two gas ejection ports 231 are formed in the upper end of each of the first parts 230 of the third risers.

The exhaust runner mold 300 is placed in an upper part between the first mold 100 and the second mold 200. As shown in FIG. 2, a second part 310 of the exhaust manifold cavity, which forms the exhaust manifold cavity in combination with the first part 220 of the exhaust manifold cavity of the second mold 200, is formed on a first surface of the exhaust runner mold 300.

Further, second parts 320 of the third risers, which form the third risers in combination with the first parts 230 of the third risers of the second mold 200, are formed at locations above the second part 310 of the exhaust manifold cavity. A gas ejection port 321 extends upward from the upper end of each of the second parts 320 of the third risers. The gas ejection port 321 is open in the upper end thereof and ejects gas to the outside of the gravity casting mold.

As shown in FIG. 1, a second part 330 of the first riser, a second part 340 of the sprue, a second part 345 of the runner, and a second part 350 of the second riser are formed on a second surface of the exhaust runner mold 300.

Here, the second part 330 of the first riser is configured to form the first riser in combination with the first part 120 of the first riser of the first mold 100. A gas ejection port 331 extends upward from the upper end of the second part 330 of the first riser. The gas ejection port 331 is open in the upper end thereof and ejects gas to the outside of the gravity casting mold.

The second part 340 of the sprue and the second part 345 of the runner are configured to respectively form the sprue and the runner in combination with the first part 130 of the sprue and the first part 135 of the runner of the first mold 100. Here, the second part 340 of the sprue is configured such that the upper end thereof is open and the sectional area thereof is gradually reduced in a downward direction.

The second part 350 of the second riser is configured to form the second riser in combination with the first part 140 of the second riser of the first mold 100.

In the above-mentioned exhaust runner mold 300, a second part 346 of the first gate, which connects the second part 345 of the runner to the second part 330 of the first riser, is formed, so the second part 345 of the runner communicates with the second part 330 of the first riser by the second part 346 of the first gate. Here, the second part 346 of the first gate forms the first gate in combination with the first part 136 of the first gate of the first mold 100.

The twin scroll mold 500 is placed in a lower part between the first mold 100 and the second mold 200, and forms a lower part of the turbine housing cavity.

Further, a plurality of cores are placed in the gravity casting mold so as to form spaces in the mold.

Figure 4:
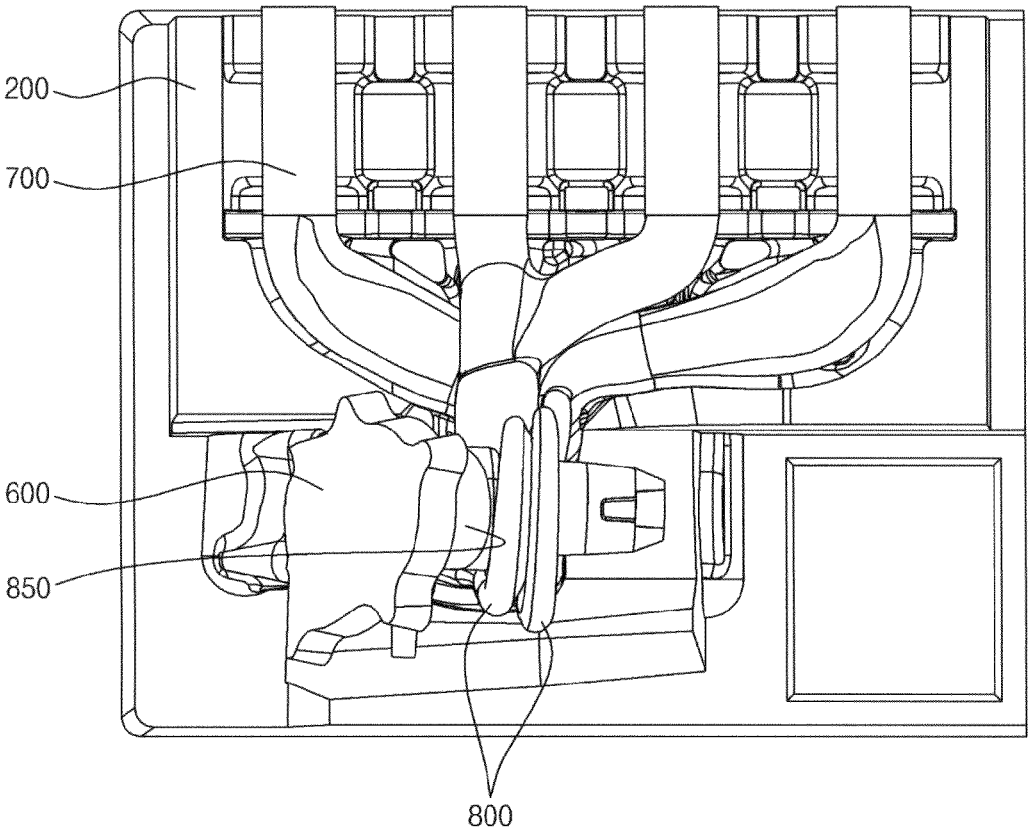
FIGS. 4 and 5 are views illustrating an arrangement of cores in the gravity casting mold.
Figure 5:
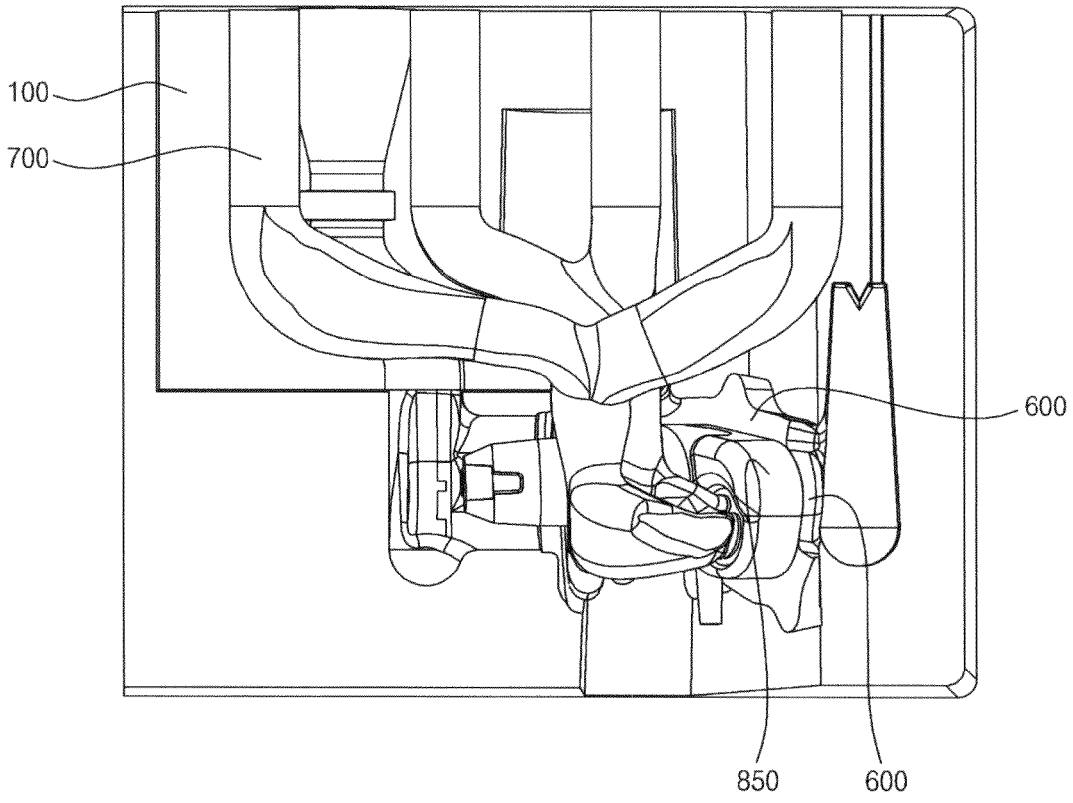

Described in detail, the gravity casting mold of the present embodiment includes a main gate core 550, an exhaust runner core 700, a twin scroll part core 800, a bypass part core 850 and a sub-gate core 600 therein, as shown in FIGS. 1 and 2. The cores are placed in the gravity casting mold at respective locations as shown in FIGS. 4 and 5.

The main gate core 550 is placed at a location below the first part 135 of the runner of the first mold 100 and the second part 345 of the runner of the exhaust runner mold 300, so the main gate core 550 connects the runner to the turbine housing cavity, and forms a plurality of second gates.

Figure 10:
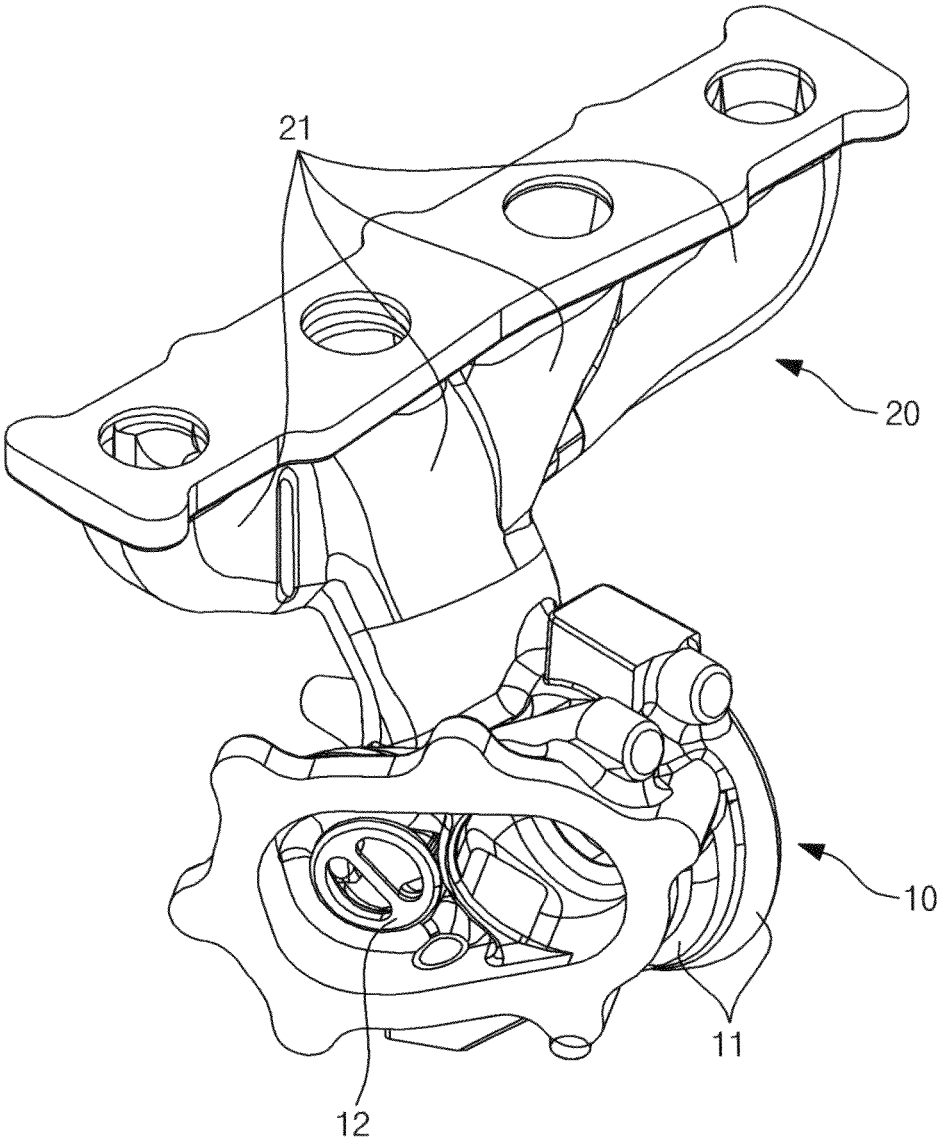
FIG. 10 is a view illustrating a cast product.

The exhaust runner core 700 is placed between the second mold 200 and the exhaust runner mold 300 at a position inside the exhaust manifold cavity, and forms an exhaust runner section 21 of an exhaust manifold 20 (see FIG. 10).

The twin scroll part core 800 and the bypass part core 850 are placed between the first mold 100 and the second mold 200 at locations inside the turbine housing cavity, and respectively form a twin scroll section 11 and a bypass section 12 which are formed by inner spaces of the turbine housing.

In the present embodiment, the twin scroll part core 800 is integrated with the exhaust runner core 700 into a single body. Here, the exhaust runner core 700 is composed of four exhaust runner cores, and the first and fourth cores of the four exhaust runner cores 700 are integrally connected to a part of the twin scroll part core 800 which forms a first part of the twin scroll part 111 in the mold. Further, the second and third cores of the four exhaust runner cores 700 are integrally connected to another part of the twin scroll part core 800 which forms a second part of the twin scroll part 111.

The sub-gate core 600 is placed in a lower part between the first mold 100 and the second mold 200 at a location next to the bypass part core 850. The sub-gate core 600 connects the second riser to the bypass part core 850, and forms a plurality of third gates.

When the first part 110 of the turbine housing cavity of the first mold 100 engages with the second part 210 of the turbine housing cavity of the second mold 200 in such a way that the two parts 110 and 210 face each other in the gravity casting mold assembly, the turbine housing cavity is formed by the twin scroll mold 500.

Further, the first part 120 of the first riser of the first mold 100 engages with the second part 330 of the first riser of the exhaust runner mold 300 in such a way that the two parts 120 and 330 face each other in the gravity casting mold assembly, so the first riser is formed. In the same manner, the first part 130 of the sprue of the first mold 100 and the first part 135 of the runner respectively engage with the second part 340 of the sprue and the second part 345 of the runner of the exhaust runner mold 300, so the sprue and the runner are formed in the gravity casting mold assembly. Here, the lowermost end of the runner are divided into two parts by the main gate core 550 that connects the runner to the turbine housing cavity, and the two parts of the runner are connected to the twin scroll part 111, as shown in FIG. 2.

Further, the first part 140 of the second riser of the first mold 100 engages with the second part 350 of the second riser of the exhaust runner mold 300 in such a way that the two parts 140 and 350 face each other, so the second riser is formed in the gravity casting mold assembly.

Further, the first part 220 of the exhaust manifold cavity of the second mold 200 engages with the second part 310 of the exhaust manifold cavity of the exhaust runner mold 300, so the exhaust manifold cavity is formed in the gravity casting mold assembly. In addition, the first parts 230 of the third risers of the second mold 200 engage with the second parts 320 of the third risers of the exhaust runner mold 300, so the third risers are formed in the gravity casting mold assembly.

In the present invention, to prevent shrinkage of the internal shape of the mold, the diameter of the first riser may be configured to be larger than the diameter of the lowermost end of the sprue within a range of 1.5 to 2.5 times.

Further, in an effort to prevent shrinkage of molten metal in the twin scroll part 111, a heating sleeve 400 may be provided in the first riser, as shown in FIGS. 1 and 2. Here, the heating sleeve 400 has a high temperature heat generating function and an excellent insulation function, so the heating sleeve 400 can maintain the high temperature of the molten metal in the first riser without lowering the temperature. In other words, the gravity casting mold of this invention provides the function of maintaining the temperature of the molten metal in the first riser, so, when the molten metal in the twin scroll part 111 of the mold cools and shrinks, the present invention can prevent the cooling and shrinking of the molten metal in the twin scroll part 111 by feeding hot molten metal to the twin scroll part 111. Accordingly; the present invention can greatly increase the quality of cast products.

Figure 3:
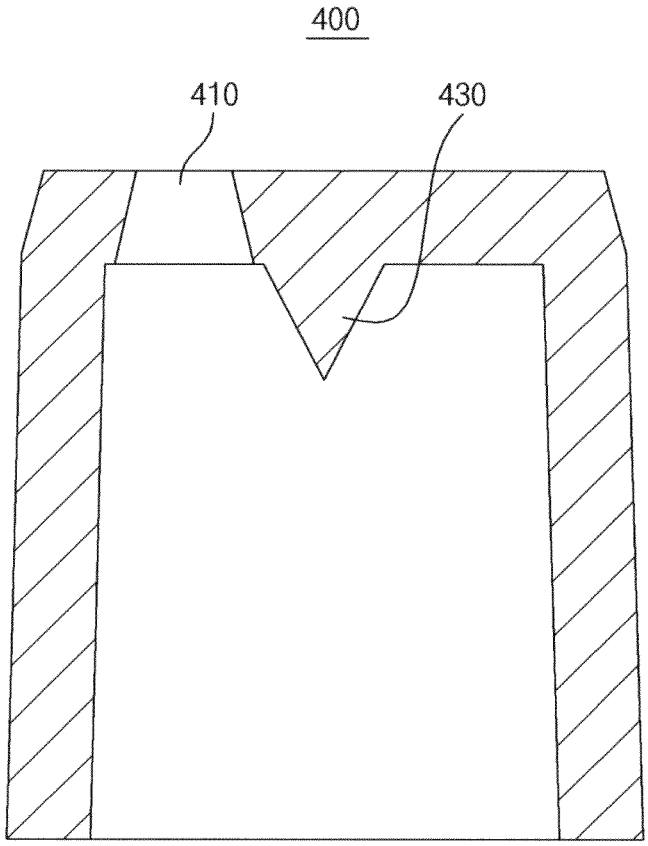
FIG. 3 is a sectional view illustrating a heating sleeve shown in FIGS. 1 and 2.

As shown in FIG. 3, the heating sleeve 400 has a cylindrical structure, in which the width between opposed portions of the sidewall is gradually increased in a downward direction.

Further, the heating sleeve 400 is open in the lower end thereof and is closed in the upper end thereof, with a gas ejection hole 410 formed through the upper end of the heating sleeve 400. In the present embodiment, the gas ejection hole 410 has a semicircular shape, and communicates with the gas ejection ports 121 and 331 that are formed in the first riser, so gas can be expelled from the first riser to the outside through the gas ejection hole 410 and through the gas ejection ports 121 and 331.

In addition, a guide protrusion 430 that has a downward tapering shape may be formed on the inner surface of the upper end of the heating sleeve 400. In the present embodiment, the guide protrusion 430 is formed at a position next to the gas ejection hole 410. The guide protrusion 430 can guide the molten metal in the heating sleeve 400 to flow downward.

Further, as shown in FIGS. 1 and 2, a sprue cup 450 may be provided in the sprue so as to maintain the temperature of the molten metal in the sprue.

Here, the shape of the sprue cup 450 is configured such that the width between opposed portions of the sidewall of the sprue cup 450 is gradually reduced in a downward direction so as to correspond to the shape of the sprue. The sprue cup 450 is opened in the upper and lower ends thereof, with a protruding piece 451 formed on the edge of the upper end of the sprue cup 450 by protruding radially outward.

Further, at least one deformation resisting groove 453 is formed on the outer circumferential surface of the sprue cup 450, so the sprue cup 450 can efficiently resist thermal deformation that may be caused by hot molten metal poured through the sprue cup 450. In the present embodiment, the deformation resisting groove 453 has a rectangular recess shape and is composed of four grooves that are formed on the outer circumferential surface of the sprue cup 450 at regular intervals. However, the number and arrangement of the deformation resisting grooves 453 may be changed according to embodiments of the present invention.

Hereinbelow, the process of feeding molten metal into the above-mentioned gravity casting mold according to the preferred embodiment of the present invention will be described.

Figure 6:
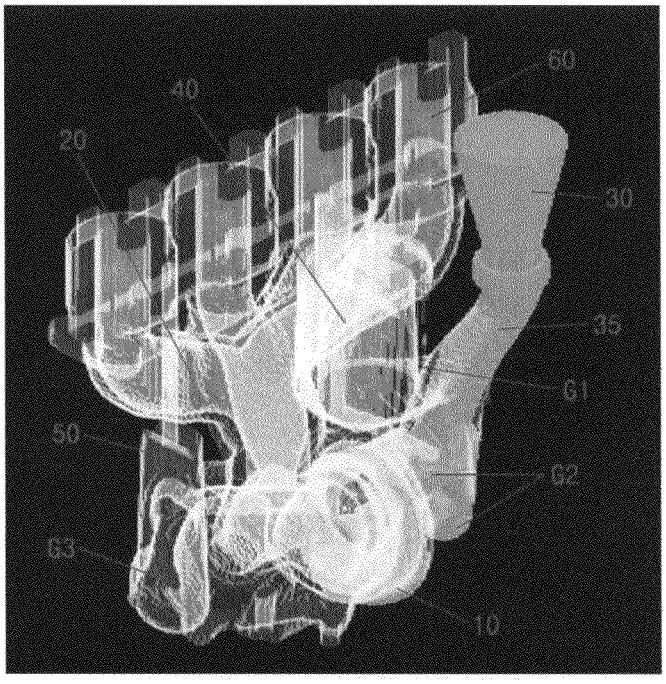
FIGS. 6 to 8 are views illustrating the feeding of a molten metal into the gravity casting mold.

First, as shown in FIG. 6, hot molten metal is poured into the assembled gravity casting mold through the sprue 30 and the runner 35. Here, the lowermost end of the runner 35 is divided into two parts by the main gate core 550, so the molten metal can flow into the twin scroll part 111 of the turbine housing cavity 10 through the two second gates G2.

Figure 7:
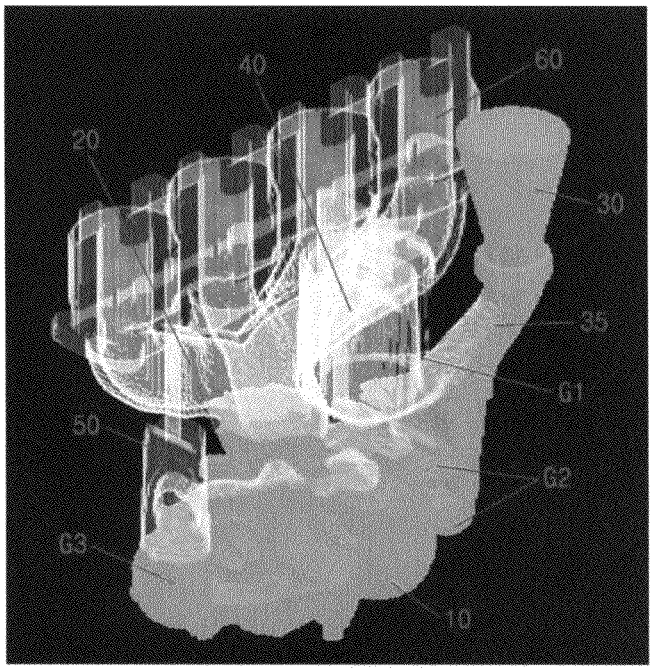
Figure 8:
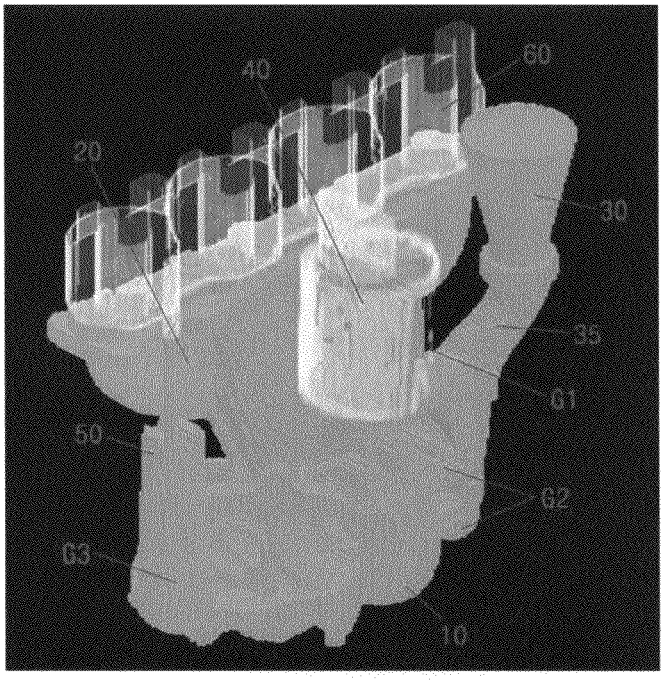

As shown in FIG. 7, the poured molten metal primarily fills the turbine housing cavity 10 through the two second gates G2. After filling the turbine housing cavity 10, the molten metal flows from the turbine housing cavity 10 to the lower end of the second riser 50 through the third gates G3 that are formed by the sub-gate core 600. In this case, the molten metal primarily fills the first riser 40 from the bottom by the first gate G1 formed in the runner 35. After filling the first riser 40, the molten metal sequentially fills the cavity of the exhaust manifold 20 which communicates with the turbine housing cavity 10, and fills the third risers 60, as shown in FIG. 8.

Figure 9:
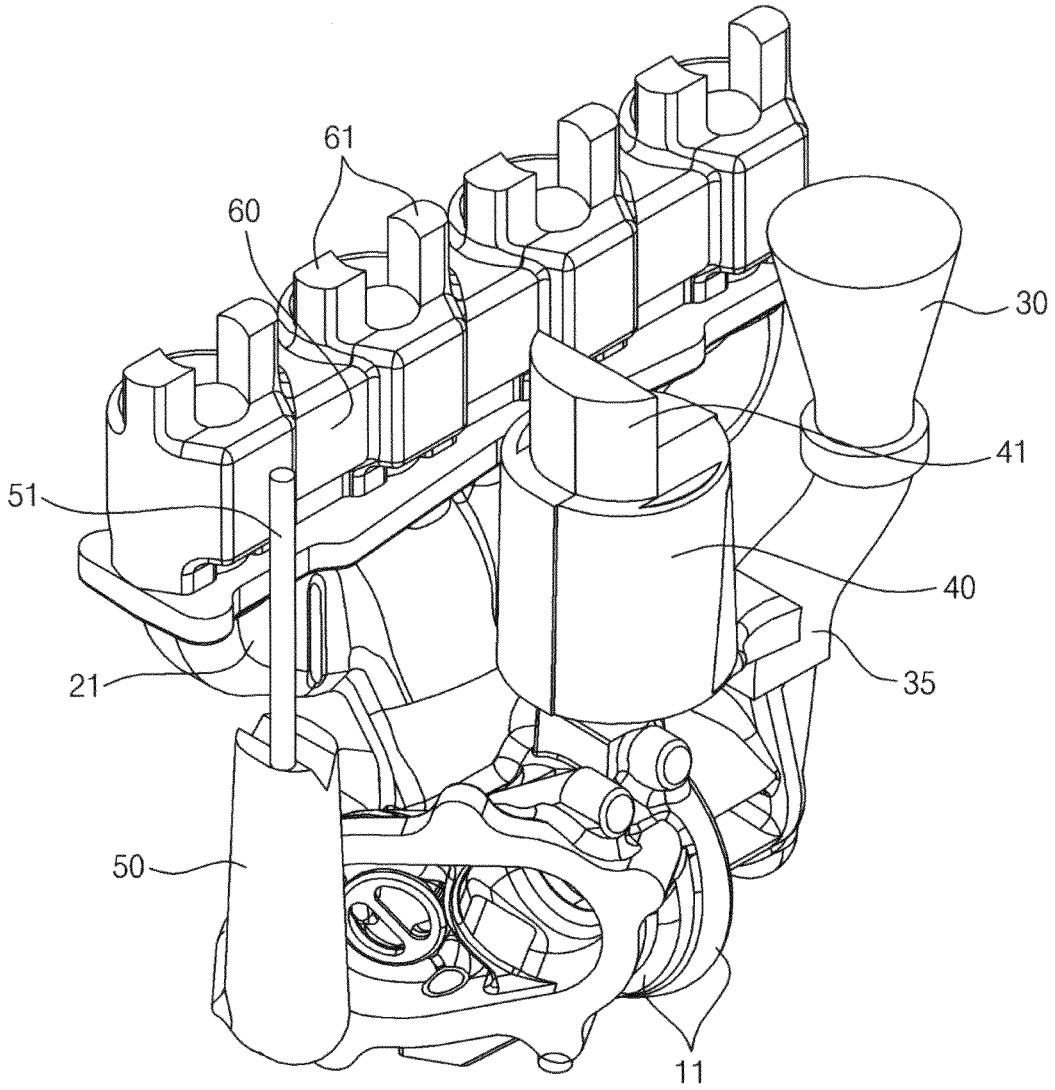
FIG. 9 is a view illustrating a casting formed using the gravity casting mold of FIGS. 1 and 2.

FIG. 9 illustrates a casting formed using the gravity casting mold of the present invention, in which the sprue 30, the runner 35, the first riser 40, the gas ejection port 41, the second riser 50, the gas ejection port 51, the third risers 60, and the gas ejection ports 61 are integrated with each other.

As shown in FIG. 9, when cutting useless parts, such as the sprue 30, the runner 35, the first riser 40, the gas ejection port 41, the second riser 50, the gas ejection port 51, the third risers 60, and the gas ejection ports 61, from the casting, a cast product is provided as shown in FIG. 10.

As shown in FIG. 10, in the cast product, the turbine housing 10 is integrated with the exhaust manifold 20 into a single body. Here, the turbine housing 10 includes the twin scroll section 11 and the bypass section 12, and the exhaust manifold 20 includes a plurality of exhaust runner sections 21.

Figure 11:
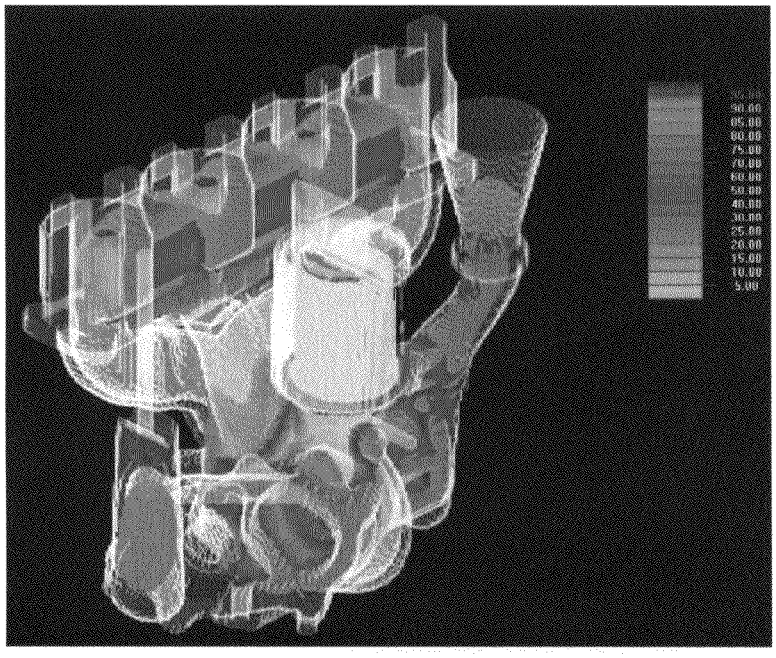
FIGS. 11 and 12 are views illustrating simulation results of solidification analysis of the casting formed using the gravity casting mold of FIGS. 1 and 2.
Figure 12:
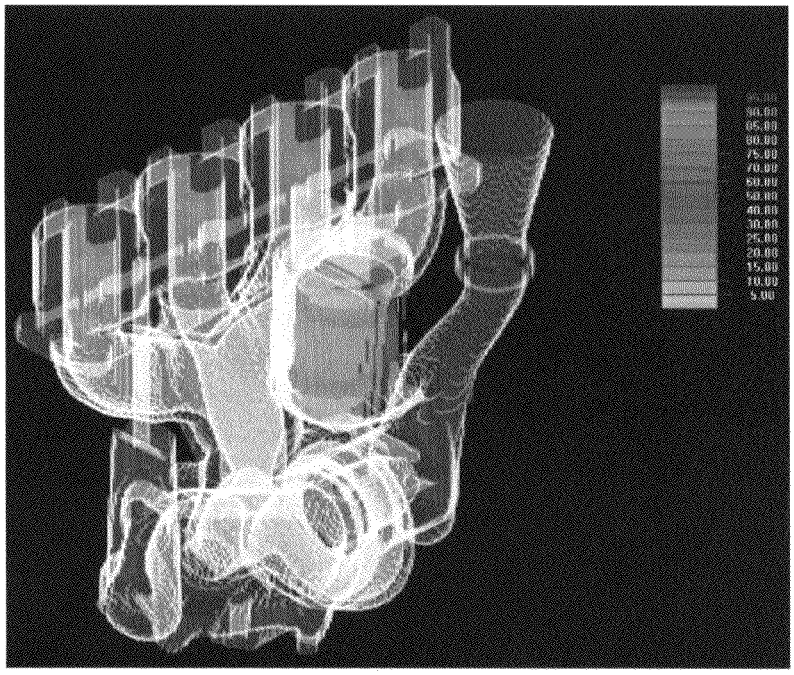

FIGS. 11 and 12 are views illustrating simulation results of solidification analysis of the casting formed using the gravity casting mold of FIGS. 1 and 2.

As shown in FIG. 11, the solidification rate is low in the first riser, the third risers and the upper part of the turbine housing cavity. Particularly, it is noted that the solidification rate in the first risers is lowest, as shown in FIG. 12.

According to the above-mentioned difference in the solidification rate, the following shrinkage results may be obtained.

Figure 13:
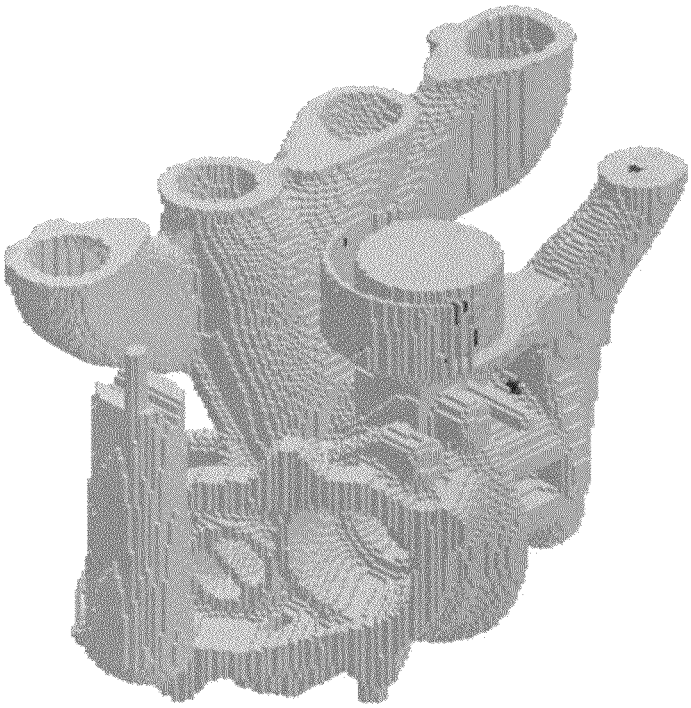
FIGS. 13 to 15 are views illustrating results of shrinkage according to different sections of the casting formed using the gravity casting mold of FIGS. 1 and 2.
Figure 14:
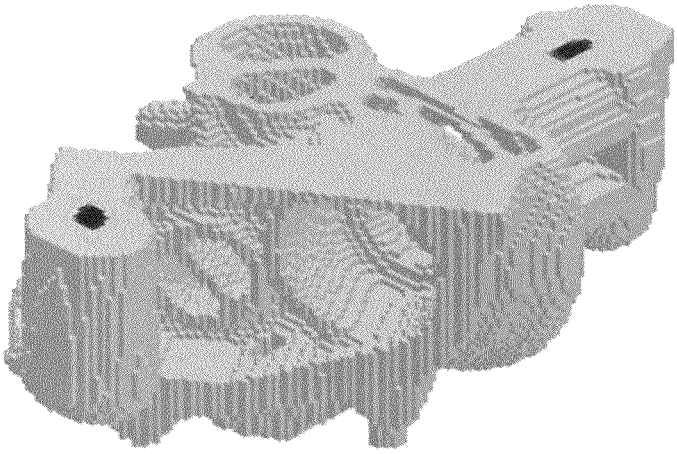
Figure 15:
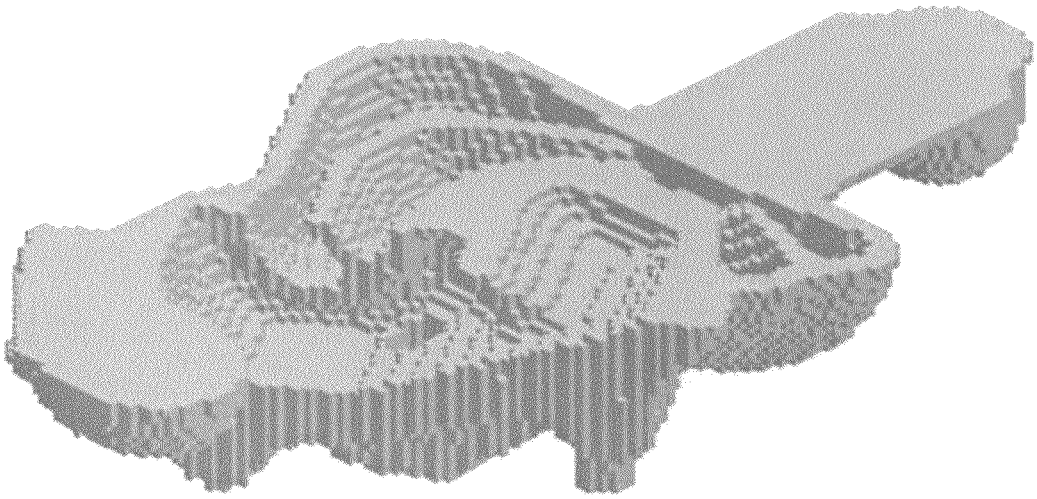

FIGS. 13 to 15 are views illustrating shrinkage results according to different sections of the casting formed using the gravity casting mold of the present invention.

As shown in FIGS. 13 to 15, it is noted that shrinkage is partially generated in the useless parts, such as the runner, the gates, the first riser, the second riser, etc., and no shrinkage is generated in all the useful parts of the cast product.

As will be noted from the above-mentioned results, the gravity casting mold according to the preferred embodiment of the present invention is advantageous in that gas generated during the charging of the molten metal in the mold can be efficiently expelled to the outside through the gas ejection ports 121 and 331 of the first riser and through the gas ejection port 141 of the second riser, so it is possible to prevent mixing of gas with molten metal in the end of the twin scroll part and to avoid shrinkage defects that may be formed on the surface of the cast product.

Further, when the molten metal both in the turbine housing cavity and in the exhaust manifold cavity of the mold cools and shrinks, hot molten metal is fed from both the first riser and the second riser into the turbine housing cavity, and hot molten metal is fed from the third riser into the exhaust manifold cavity, so the short amount of molten metal caused by the cooling and shrinking of the molten metal can be replenished. Accordingly, the present invention can prevent shrinkage defects of cast products, and increases the casting quality of the cast products.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A gravity casting mold, comprising:

a first mold including:

a first part of a turbine housing cavity formed in a lower part of the first mold and having a twin scroll part;

a first part of a first riser formed at a location above the twin scroll part;

first parts of a sprue and of a runner formed in a first side of the twin scroll part so as to feed molten metal into the twin scroll part; and a first part of a second riser formed in a second side of the twin scroll part;

a second mold assembled with the first mold, the second mold including:

a second part of the turbine housing cavity formed in a lower part of the second mold and engaged with the first part of the turbine housing cavity of the first mold so as to form the turbine housing cavity;

a first part of an exhaust manifold cavity formed in an upper part of the second mold and connected to the second part of the turbine housing cavity; and a first part of a third riser formed at a location above the first part of the exhaust manifold cavity; and an exhaust runner mold placed in an upper part between the first mold and the second mold, wherein a first surface of the exhaust runner mold includes:

a second part of the exhaust manifold cavity engaged with the first part of the exhaust manifold cavity of the second mold so as to form the exhaust manifold cavity; and a second part of the third riser formed at a location above the second part of the exhaust manifold cavity and engaged with the first part of the third riser so as to form the third riser, and a second surface of the exhaust runner includes:

a second part of the first riser engaged with the first part of the first riser of the first mold so as to form the first riser;

second parts of the sprue and of the runner engaged with the first parts of the sprue and of the runner of the first mold so as to form the sprue and the runner; and a second part of the second riser engaged with the first part of the second riser of the first mold so as to form the second riser, wherein a heating sleeve is provided in the first riser so as to prevent shrinkage of the molten metal in the twin scroll part, wherein the heating sleeve is closed in an upper end, with a gas ejection hole formed through the upper end of the heating sleeve.

2. The gravity casting mold as set forth in claim 1, wherein the heating sleeve has a cylindrical shape, with a width between opposed portions of a sidewall of the heating sleeve gradually increased in a downward direction.

3. The gravity casting mold as set forth in claim 2, wherein upper ends of the first part of the first riser of the first mold and of the second part of the first riser of the exhaust runner mold are provided with gas ejection ports, the gas ejection ports communicating with the gas ejection hole of the heating sleeve and being open in upper ends so as to expel gas from the first riser.

4. The gravity casting mold as set forth in claim 2, wherein the heating sleeve is provided on an inner surface of the upper end thereof with a guide protrusion having a downward tapering shape.

5. The gravity casting mold as set forth in claim 1, wherein a sprue cup is provided in the sprue so as to maintain a temperature of the molten metal in the sprue.

6. The gravity casting mold as set forth in claim 1, wherein the first riser has a diameter larger than a diameter of a lowermost end of the sprue within a range of 1.5 to 2.5 times.

7. The gravity casting mold as set forth in claim 1, wherein the first mold is provided with a first part of a first gate, the first part of the first gate connecting the first part of the runner to the first part of the first riser, and the exhaust runner mold is provided with a second part of the first gate, the second part of the first gate connecting the second part of the runner to the second part of the first riser and engaged with the first part of the first gate so as to form the first gate.

8. The gravity casting mold as set forth in claim 1, further comprising:

a twin scroll mold placed in a lower part between the first mold and the second mold and forming a lower part of the turbine housing cavity;

a main gate core placed in a lower part between the first part of the runner of the first mold and the second part of the runner of the exhaust runner mold, the main gate core connecting the runner to the turbine housing cavity and forming a plurality of second gates;

an exhaust runner core placed between the second mold and the exhaust runner mold at a location inside the exhaust manifold cavity and forming an exhaust runner of an exhaust manifold;

a twin scroll part core and a bypass part core placed between the first mold and the second mold at locations inside the turbine housing cavity, and respectively forming a twin scroll section and a bypass section which are formed by an inner space of a turbine housing; and a sub-gate core placed in the lower part between the first mold and the second mold at a location next to the bypass part core, the sub-gate core connecting the second riser to the bypass part core and forming a plurality of third gates.

9. The gravity casting mold as set forth in claim 2, further comprising:

a twin scroll mold placed in a lower part between the first mold and the second mold and forming a lower part of the turbine housing cavity;

a main gate core placed in a lower part between the first part of the runner of the first mold and the second part of the runner of the exhaust runner mold, the main gate core connecting the runner to the turbine housing cavity and forming a plurality of second gates;

an exhaust runner core placed between the second mold and the exhaust runner mold at a location inside the exhaust manifold cavity and forming an exhaust runner of an exhaust manifold;

a twin scroll part core and a bypass part core placed between the first mold and the second mold at locations inside the turbine housing cavity, and respectively forming a twin scroll section and a bypass section which are formed by an inner space of a turbine housing; and a sub-gate core placed in the lower part between the first mold and the second mold at a location next to the bypass part core, the sub-gate core connecting the second riser to the bypass part core and forming a plurality of third gates.

10. The gravity casting mold as set forth in claim 3, further comprising:

a twin scroll mold placed in a lower part between the first mold and the second mold and forming a lower part of the turbine housing cavity;

a main gate core placed in a lower part between the first part of the runner of the first mold and the second part of the runner of the exhaust runner mold, the main gate core connecting the runner to the turbine housing cavity and forming a plurality of second gates;

an exhaust runner core placed between the second mold and the exhaust runner mold at a location inside the exhaust manifold cavity and forming an exhaust runner of an exhaust manifold;

a twin scroll part core and a bypass part core placed between the first mold and the second mold at locations inside the turbine housing cavity, and respectively forming a twin scroll section and a bypass section which are formed by an inner space of a turbine housing; and a sub-gate core placed in the lower part between the first mold and the second mold at a location next to the bypass part core, the sub-gate core connecting the second riser to the bypass part core and forming a plurality of third gates.

11. The gravity casting mold as set forth in claim 4, further comprising:

a twin scroll mold placed in a lower part between the first mold and the second mold and forming a lower part of the turbine housing cavity;

a main gate core placed in a lower part between the first part of the runner of the first mold and the second part of the runner of the exhaust runner mold, the main gate core connecting the runner to the turbine housing cavity and forming a plurality of second gates;

an exhaust runner core placed between the second mold and the exhaust runner mold at a location inside the exhaust manifold cavity and forming an exhaust runner of an exhaust manifold;

a twin scroll part core and a bypass part core placed between the first mold and the second mold at locations inside the turbine housing cavity, and respectively forming a twin scroll section and a bypass section which are formed by an inner space of a turbine housing; and a sub-gate core placed in the lower part between the first mold and the second mold at a location next to the bypass part core, the sub-gate core connecting the second riser to the bypass part core and forming a plurality of third gates.

12. The gravity casting mold as set forth in claim 5, further comprising:

a twin scroll mold placed in a lower part between the first mold and the second mold and forming a lower part of the turbine housing cavity;

a main gate core placed in a lower part between the first part of the runner of the first mold and the second part of the runner of the exhaust runner mold, the main gate core connecting the runner to the turbine housing cavity and forming a plurality of second gates;

an exhaust runner core placed between the second mold and the exhaust runner mold at a location inside the exhaust manifold cavity and forming an exhaust runner of an exhaust manifold;

a twin scroll part core and a bypass part core placed between the first mold and the second mold at locations inside the turbine housing cavity, and respectively forming a twin scroll section and a bypass section which are formed by an inner space of a turbine housing; and a sub-gate core placed in the lower part between the first mold and the second mold at a location next to the bypass part core, the sub-gate core connecting the second riser to the bypass part core and forming a plurality of third gates.

13. The gravity casting mold as set forth in claim 6, further comprising:

a twin scroll mold placed in a lower part between the first mold and the second mold and forming a lower part of the turbine housing cavity;

a main gate core placed in a lower part between the first part of the runner of the first mold and the second part of the runner of the exhaust runner mold, the main gate core connecting the runner to the turbine housing cavity and forming a plurality of second gates;

an exhaust runner core placed between the second mold and the exhaust runner mold at a location inside the exhaust manifold cavity and forming an exhaust runner of an exhaust manifold;

a twin scroll part core and a bypass part core placed between the first mold and the second mold at locations inside the turbine housing cavity, and respectively forming a twin scroll section and a bypass section which are formed by an inner space of a turbine housing; and a sub-gate core placed in the lower part between the first mold and the second mold at a location next to the bypass part core, the sub-gate core connecting the second riser to the bypass part core and forming a plurality of third gates.

14. The gravity casting mold as set forth in claim 7, further comprising:

a twin scroll mold placed in a lower part between the first mold and the second mold and forming a lower part of the turbine housing cavity;

a main gate core placed in a lower part between the first part of the runner of the first mold and the second part of the runner of the exhaust runner mold, the main gate core connecting the runner to the turbine housing cavity and forming a plurality of second gates;

an exhaust runner core placed between the second mold and the exhaust runner mold at a location inside the exhaust manifold cavity and forming an exhaust runner of an exhaust manifold;

a twin scroll part core and a bypass part core placed between the first mold and the second mold at locations inside the turbine housing cavity, and respectively forming a twin scroll section and a bypass section which are formed by an inner space of a turbine housing; and a sub-gate core placed in the lower part between the first mold and the second mold at a location next to the bypass part core, the sub-gate core connecting the second riser to the bypass part core and forming a plurality of third gates.

* * * * *